US005317882A

United States Patent [19]

Ritenour

[11] Patent Number: 5,317,882

[45] Date of Patent: Jun. 7, 1994

[54] UNIQUE WATER VAPOR VACUUM REFRIGERATION SYSTEM

[76] Inventor: Paul E. Ritenour, 1255 Calle Santiago, Chula Vista, Calif. 91910

[21] Appl. No.: 53,913

[22] Filed: Apr. 27, 1993

[51] Int. Cl.[5] ..... F25B 19/00

[52] U.S. Cl. ..... 62/268; 415/72

[58] Field of Search ..... 62/99, 268, 270; 415/71, 72; 416/176

[56] References Cited

U.S. PATENT DOCUMENTS 4,577,465 3/1986 Olsen et al. ..... 62/268

5,169,502 12/1992 Mugele ..... 62/268

*Primary Examiner*—John M. Sollecito

[57] ABSTRACT

A water vapor vacuum refrigeration chilled water system with a compressor that allows flash cooling refrigeration system to be practical size and weight. The system utilizes only water vapor. Innovative features include a unique plenum condenser system which allows the refrigeration system to be totally enclosed with little or no effect of ambient temperatures on system performances. The plenum type spray condenser does not need fins or tubes as common refrigeration condensers. The compressor allows the large volume of water vapor to be compressed at high pressure ratios. The compressor is much smaller and lighter than state of the art positive or centrifugal type compressor for the required compression requirements. The compressor sections are made with two dissimilar type compressor rotating sections to obtain the required pressure ratios and flows.

16 Claims, 5 Drawing Sheets

| BLADE CONFIGURATION CHANNEL TABLE | | | | |
|---|---|---|---|---|
| SECTION | DISTANCE FROM DATUM Y | Dm RADII FROM Z | RADII FROM DATUM Z TO CENTER CIRCLE | DIA. OF CONSTRUCT. CIRCLE INCH |
| a | 0 INCH | 5.91 | 5.68 | 3.25 |
| b | 1.0 | 5.79 | 5.58 | 3.00 |
| c | 2.0 | 6.91 | 5.48 | 2.82 |
| d | 3.0 | 5.55 | 5.35 | 2.62 |
| e | 4.0 | 5.45 | 5.28 | 2.38 |
| f | 5.0 | 5.30 | 5.18 | 2.20 |
| g | 6.0 | 5.19 | 5.08 | 2.00 |
| h | 7.0 | 5.10 | 4.96 | 1.82 |
| i | 8.0 | 4.96 | 4.88 | 1.60 |
| j | 9.0 | 4.85 | 4.77 | 1.40 |
| k | 10.0 | 4.76 | 4.69 | 1.17 |
| l | 11.0 | 4.65 | 4.55 | 1.00 |
| m | 12.0 | 4.50 | 4.46 | .815 |

UNIQUE WATER VAPOR VACUUM REFRIGERATION SYSTEM

BACKGROUND—FIELD OF INVENTION

This invention relates to the need to improve refrigeration systems which utilize chilled water. Applications for this type of refrigeration include both process cooling and common air conditioning required for homes, commercial buildings, hospitals and manufacturing facilities. Water flash cooling vacuum vapor refrigeration systems do not use CFC (chlorofluorocarbons) refrigerants gases which damage the atmosphere or the dangerous ammonia and propane systems being proposed for larger systems. Air cycle refrigeration used on aircraft is too inefficient for home and commercial refrigeration.

At the time of filing of this patent there is much concern and activity in the refrigeration field as to which refrigerants gases will be used for replacement of the commonly used CFC's gases and CFC-11, CFC-12, in the present units and operating systems. Even the hydrochlorofluorocarbon, HCFC-22 series previously approved, environmentally are now in question. Major U.S. company has ceased manufacture of HCFC-22 equipment. The use of the expensive HCFC-123 and HFC-134A gases used in centrifugal compressor chilled water systems are in question. There are volumes of reports written on this crisis. In all cases none of these newly developed Halocarbon gases give cycle efficiency greater than the previously used CFC's. CFC refrigerants will not be produced after 1996 and manufacture is already severely reduced.

During the summer months the power used in the U.S.A. for refrigeration and air conditioning especially in commercial areas exceeds twenty five percent of the total energy utilized. Lower efficiency refrigeration systems should not be considered for this reason. It is noticeable that most American manufactures are attempting to adapt or fix their present equipment while Japanese have consortiums working to develop new types of refrigeration systems.

This patent is to introduce the proven thermodynamic principle of flashing water cooling vapor refrigeration. Water is undoubtedly the cheapest refrigerant known to man. This innovative system utilizes a unique type of vacuum vapor compressor to make the water vapor vacuum refrigeration systems applicable for air conditioning of homes, commercial establishments, and for industrial process refrigeration. Water vapor vacuum refrigeration at present is not in the state of the art for these applications, but is only used in large petrochemical and industrial applications. Only water or water glycol mixture is used as the refrigerant in the vapor vacuum refrigerant cycle.

The first historical objection to the water vapor vacuum refrigeration system has been the low operational vacuum range. This objection has now been overcome by progress in design, construction, seals and instrumentation. The second historical and most important objection is the large amount of flashed water vapor that the vacuum compressor must handle at the operating vacuum, with the low density gas and the high compression ratios required. The intent of this invention is to provide a new unique design features and a new type of compressor to overcome the objection of the large volume of vapor that must be compressed at the operating vacuum. High Pressure ratios of 4.75 to 5.75 are required for this system.

The only partially adaptable vacuum pump compressors for water vapor vacuum refrigeration units available today are the Roots type; however, they are not practical for small systems because they are slow, very large, heavy and expensive. Also at the required pressure ratio and flow requirements, an operational limit is reached on the Roots units due to mechanical clearances, heat generated and size requirements of the units. Other types positive or centrifugal compressors are too big and expensive.

Water vapor vacuum refrigeration is not new and is sometimes referred to as steam-jet refrigeration. This method utilizes multi-ejectors and are presently used where large volumes of waste steam at pressure normally from 50 PSIA to 100 PSIA, are available. For reference refer to *ASHRAE* 1983 *Equipment Handbook,* Chapter 13.1. The steam multi-ejectors are utilized to creative the low vacuum for water surface flashing in large, generally above 50 ton refrigeration capacity for the industrial and petrochemical industries. These units are huge and weigh tons and not for installation at homes, hospitals, small commercial business or industries. The theory of operation, however, is the same; to chill large quantities of water by flashing to temperatures 32° F. to 45° F. for distribution to areas for air conditioning or process cooling as in the present chilled water systems. The state of the art steam-jet system are open systems in that the chilled water is not recirculated. The coefficient of performance is low due to known inefficiencies of the multi-ejectors or steam-jets vacuum pumps.

The water vapor vacuum refrigeration unique system defined in this patent is a closed system with heat recuperation innovations resulting in a very high total overall thermal efficiency. The system is designed with a unique new type vapor compressor that will enable this system to be applicable to homes, hospitals, commercial air conditioning and industrial refrigeration requirements and process cooling. Units may be designed for load capacities as low as 3.5 tons to an approximate limit of 65 tons per unit with dual units of 130 tons of refrigeration capacity possible. Efficiency and coefficient of performance, COP, of the unique system is much higher than the present large and small Freon, CFC system thus saving much energy.

OBJECT AND ADVANTAGES OF INVENTION

The object and advantages of this invention are:

a. to provide a water vapor vacuum refrigeration systems for homes, hospitals, commercial buildings, and industrial processes that requires no halogenated chlorofluorcarbon, CFC, or the hydrochlorofluorocarbons, HCFC, gases or any gas that detriments the environment and the earth's ozone layer. Further, to provide an immediate solution to the air conditioning crisis instead of tolerating long term phaseout or removal of the above CFC gases as proposed in the Montreal Protocol Agreement.

b. to provide a refrigeration systems for homes, commercial buildings, hospitals and industrial process that is inherently much more efficient than present state of the arts refrigeration units which use the CFC or HCFC common or the new mixture gases. The energy savings realized with this new closed system could easily be 100 percent. Analytical studies and calculation of this new the water vapor vacuum refrigeration actual system show coefficient of performance, COP. of 7.25 (EER=24.3) based on the refrigeration load and the total energy input to the system. This is compared to present Freon systems with COP of 2.9, a value equivalent to an EER of 10. The system would utilize circulated chilled water 32° F. to 45° F. distributed to cooling load located in the area to be cooled as done in the present chilled water system. Only a very minute amount of make-up water would ever be added to the closed system.

c. to provide a closed refrigeration system that requires no tube-bundles, fins or cooling towers for cooling and condensing the compressed gases.

d. to provide a closed chilled water refrigeration system that needs no evaporator heat exchanger for isolating the conventional gas refrigerants from the systems circulating cooling water.

e. to provide a closed refrigeration condenser system that requires no external fluid, water or air, for cooling the load heat and thermodynamic heat of compression of the compressor.

f. to provide a refrigeration system that is a closed system where outside ambient air or external water temperatures have little or no effect on the refrigeration capacity or efficiency as in the present state of the art systems.

g. to provide a refrigeration system that operates on low pressure with less than total barometric differential pressure across any structure wall, pipe or reservoir thereby enhancing safety. Present chilled water systems operate with internal pressure from 200 to 350 PSIG requiring expensive coded pressure vessels.

h. to provide a low cost, high speed, new specific unique water vapor vacuum compressor to compress the very low density, high volume water vapor to the liquefying pressure and to be of a practical physical size that is in the present state of the art. This will allow the system to be practical for the smaller tonnage water vapor vacuum refrigeration systems. The said compressor will be a single rotor compressor without need of a gate rotor or oil injection as present systems.

i. to provide an efficient water vapor refrigeration condenser plenum that is an affixed part of the vapor compressor. Said condenser-plenum will be cooled by the returning relative cool water from the load system, and requires no fins or tubes.

j. to provide an efficient water vapor vacuum refrigeration system that will never need a variable speed driver or motor for part load conditions. The water vapor vacuum refrigeration system will operate at full load and speed or be automatically shut down due to the large residual cooling capacity of the system.

BRIEF DESCRIPTION OF THE DRAWINGS

FIG. 3-D shows the construction tabulation of radii, diameters of construction circles and distances from datums Y and Z to form the annular flow areas for a 5 ton model compressor.

DESCRIPTION OF THE PREFERRED EMBODIMENT

Figure 1:
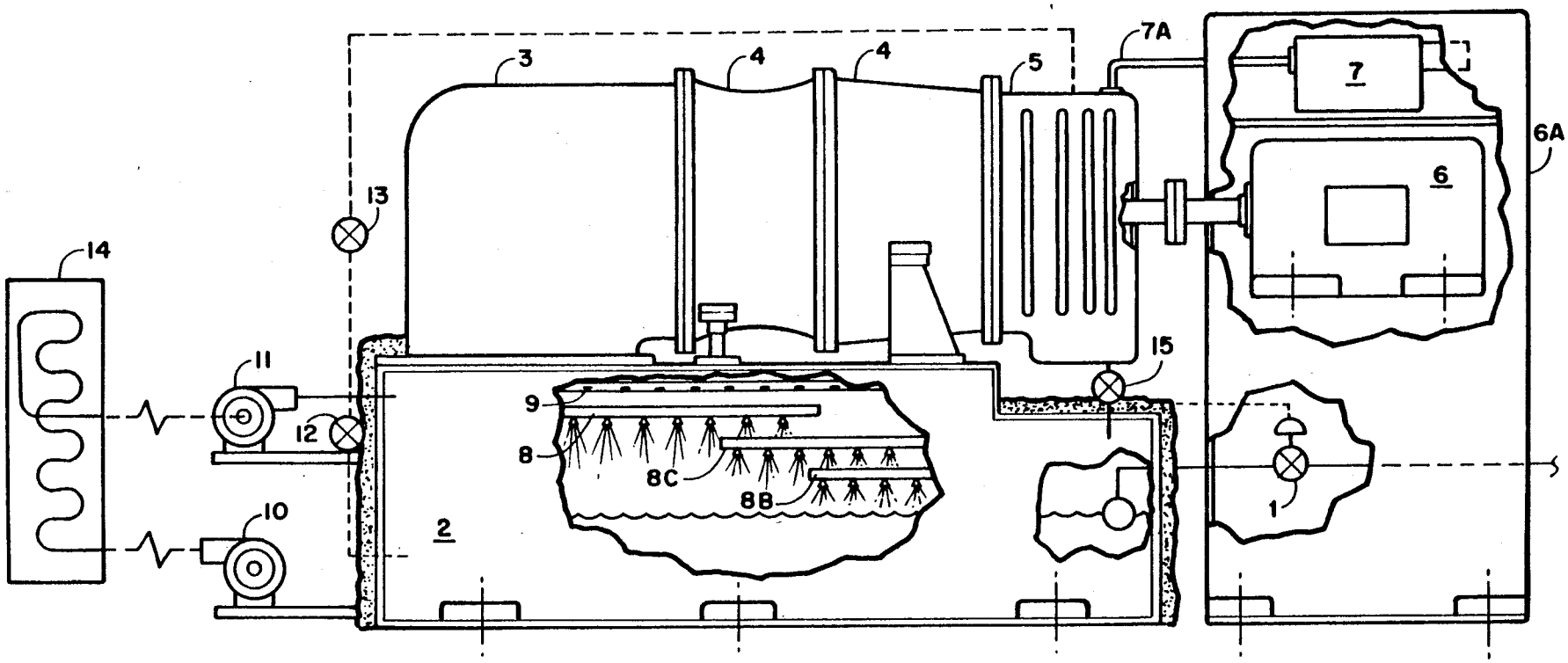
FIG. 1 is a system longitudinal perspective view of the water vapor refrigeration system as it would appear for refrigeration system sized for homes, hospitals, commercial buildings and in many industrial processes.
Figure 2:
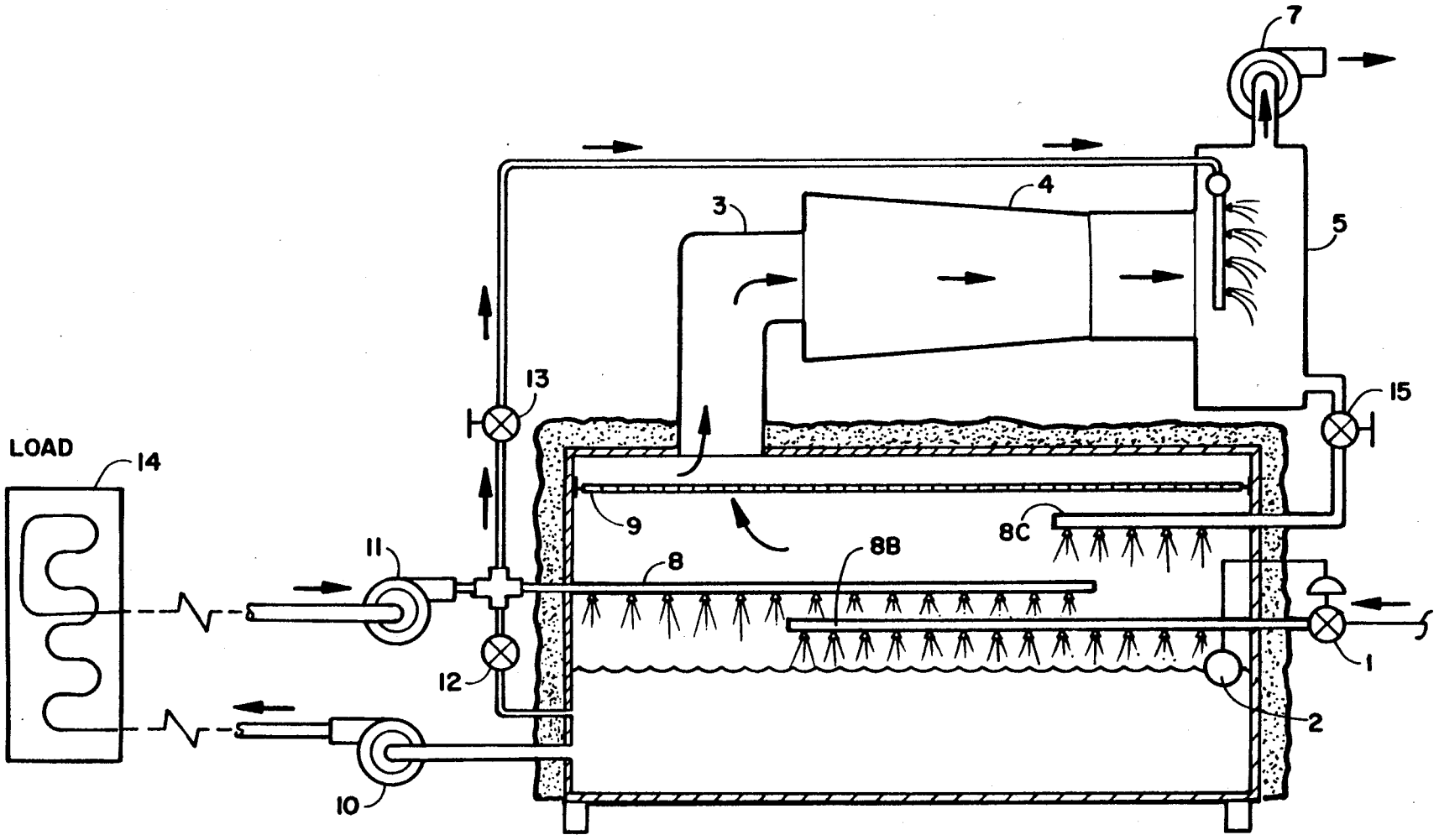
FIG. 2 shows an operational schematic of the new unique water vacuum vapor refrigeration system as shown in FIG. 1.

Referring to the drawing FIG. 1 shows the perspective view and exterior equipment and connections schematic of a water vapor vacuum system that operates and is described below. FIG. 2 shows the flow operational schematic of the water vapor vacuum system of FIG. 1. Referring to FIG. 1 and FIG. 2, the system operation and functions are as described as follows:

(a) The comparative warm supply water enter's originally through a liquid level control valve at 1 into a properly insulated tank-like evaporator 2 of any tank shape, round, square, rectangular etc. arrangement that has a level of water. The tank pressure is pumped down to the required vacuum level by a small common externally controlled auxiliary vacuum pump 7 to an approximate, vacuum of 0.147 PSIA or approximately 7.60 Torr. This pressure gives the thermodynamic saturation temperature of water at approximately 45° F. Depending on the chilled water temperature desired, other pressures levels may be required. The water is distributed by primary spray manifolds 8 and 8*c* flashes in the evaporator tank 2 into vapor, absorbing the latent heat of vaporization thus cooling the water in the tank to the thermodynamic low temperature. The spray manifold 8*b* is used only when water is introduced to the system makeup. Additional auxiliary spray manifold and surface plate systems, not shown, may be required for larger sizes. This range of vacuum is still in the laminar area of flow which enables the vapors to be compressed. The amount of make-up water flow at the entering water level control valve 1 may be zero to intermittent depending on the system leakage.

(b) The cooled or chilled water in the tank 2 is circulated by a small external load pump 10, generally of the centrifugal type, to air to water outside heat load coil or coils 14 or wherever cooling is desired as done in conventional chilled water refrigeration systems.

(c) The water distributed and flashed by the manifold spray system 8, 8*b* and 8*c* assemblies in the evaporator tank 2 is now a large amount of water vapor in the tank near dry steam but still quality vapor. The vapor passes through the special tabular spray guard assembly 9 to remove any water droplets, into the suction elbow 3 and into the vacuum vapor compressor 4 assembly to compress the vapors back to a condensing pressure level.

Compression of vapors to approximately 0.70 to 0.80 PSIA, or to 36–41 torr. requires approximately a 4.74 to 5.52 compressor pressure ratio from the pressure of the evaporator tank 2. The condensing vapors at the discharge of the compressor must also be cooled to approximately 90°–100° F. for condensation. The hot gas from compressor assembly 4 is cooled and condensed in the condenser plenum $ which is discussed later in this document. The higher temperature at the discharge of the compressor is caused by the compression heat rise. It is important to hold the condensing temperature as low as possible as in any conventional refrigeration cycle.

(d) Conventional refrigeration systems depends on the ambient air flows or tap water flow to remove this heat of compression from the compressor discharge gas. Thus the cooling media must be from an outside or external source such as ambient air or tap water in conventional systems. The described water vapor vacuum refrigeration system needs no external source cooling media, external water or ambient air, but uses a portion of the returned chilled water flow, controlled at valve assembly 13 of FIG. 1 and FIG. 2, to cool and remove the heat of compression in the condenser plenum chamber 5 discussed at (c). Approximately 60 percent of the returning chilled water flows back, or is pumped back, by the boost pump 11 into the return spraying manifold 8 through bypass control valve 12 and into evaporator tank to be reflashed and/or cooled in the tank with the resulting improvement in cycle thermal efficiency. This basic system may be modified and/or instrumentation may be varied to accomplish the intended functions.

Figure 3C:
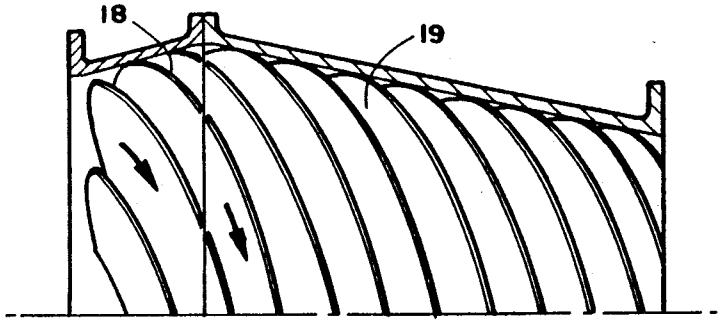
FIG. 3*c* shows the complete conformal transformation of one of the continuous blades of the compressor assembly of FIG. 3 from the inlet of the inducer section to the outlet of the vane section with the mean representative velocity diagrams of each transition sections.
Figure 3:
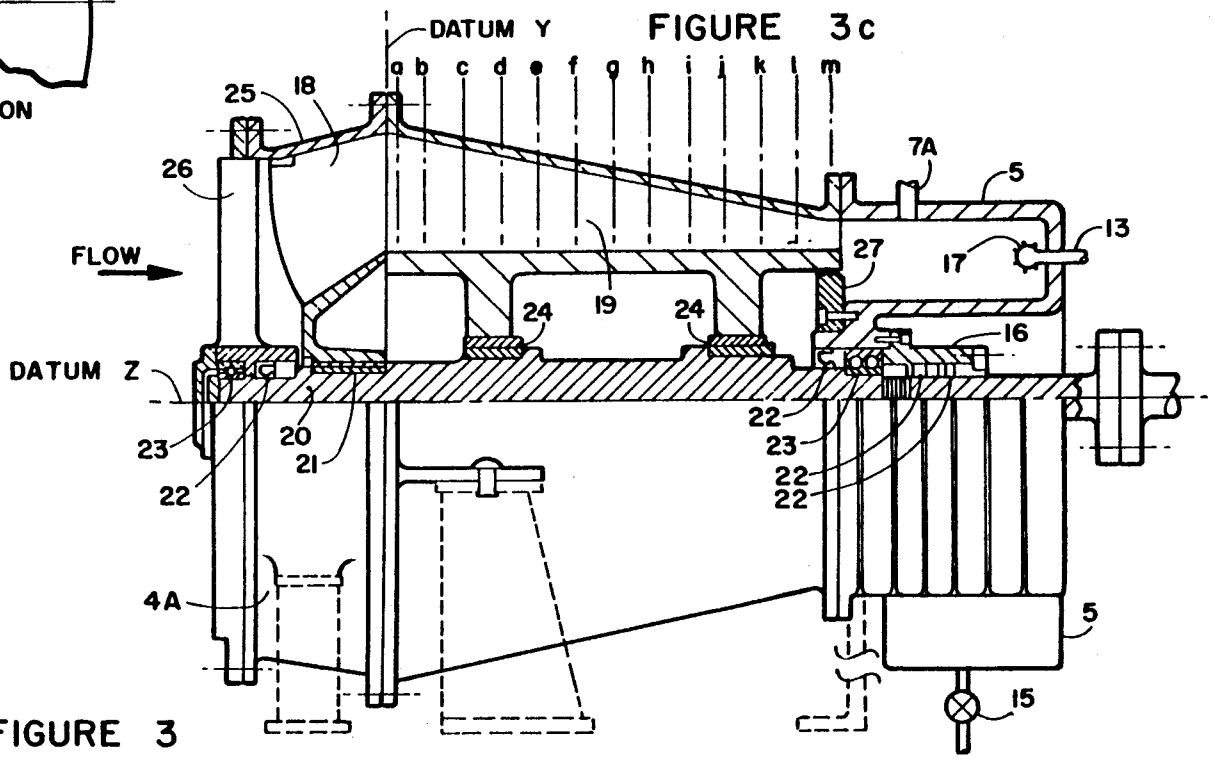
FIG. 3 shows a partial cross section view of the new unique vapor vacuum refrigeration compressor assembly.
Figure 4:
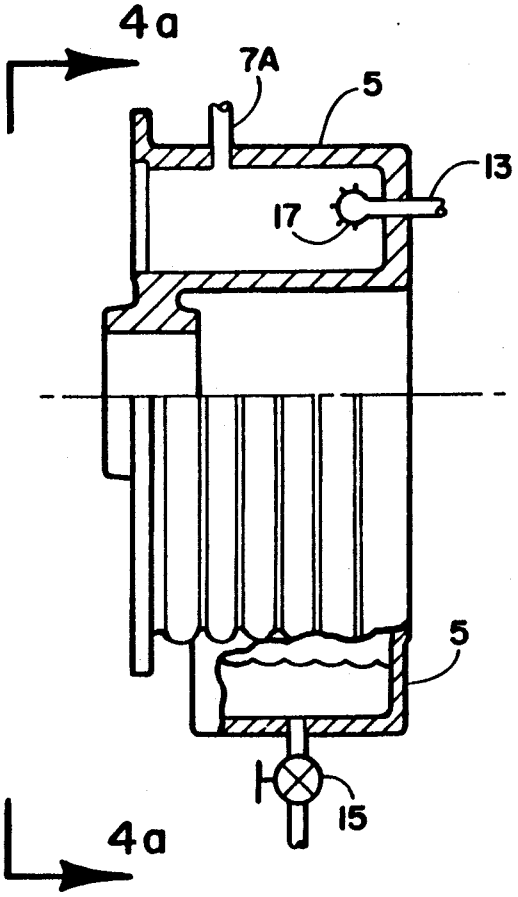
FIG. 4 shows the partial longitudinal sectional view of the unique water spray cooled condenser plenum that is affixed to the vapor vacuum refrigeration compressor of FIG. 3 and supports the compressor bearings.
Figure 4A:
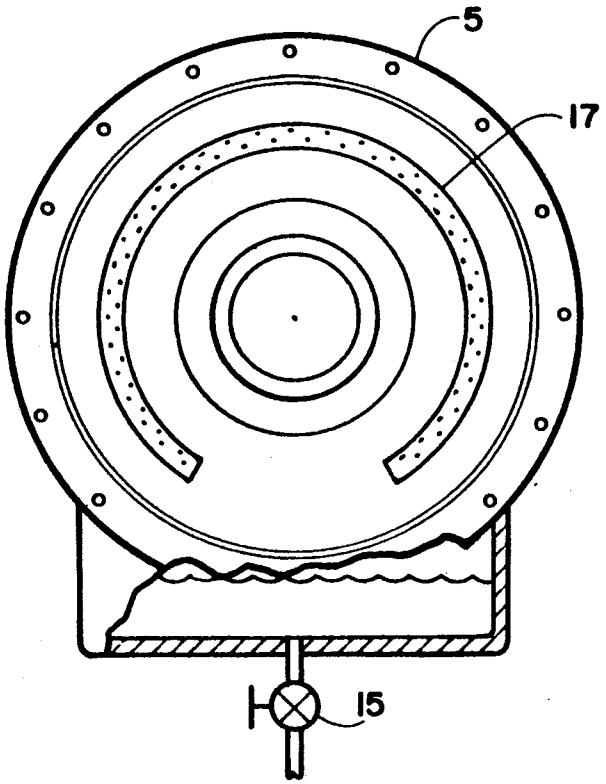
FIG. 4*a* shows the front view of the condenser plenum that is affixed to the vacuum refrigeration compressor of FIG. 3 specifically showing the arrangement of the water inlet cooling manifold arrangement and return sump.

(e) The compressed and heated vapor of the compressor exhaust into a uniquely designed special plenum chamber affixed to the vapor compressor casing at 5 of FIGS. 1, 2 and 3 which is uniquely designed to replace the conventional condenser heat exchangers of the fins and tubes and/or the air evaporator types. The unique special plenum, with no conventional tubes and fins, acts as a condenser plenum section and has an annular water-cooling spray system 17 of FIG. 4, which cools the compressed, condensed vapor for the removal of the heat of compression of the vapor compressor. The condenser plenum assembly housing supports the real bearing assembly of the compressor and is sealed at the shaft by a vacuum seal assembly 16 of FIG. 3. The returning chilled water is shown in Drawing FIG. 1 and FIG. 2 as line flow through valve 13. Little or no makeup water will normally be required at control valve 1 of FIG. 1 and FIG. 2 after the original evaporator tank is filled. The condenser plenum also has a connection for the piped system to the motor driven vacuum pump 7 which functions to remove residual leakage of air in system and also supplies the starting system pump down of the evaporator tank 2 to the starting vacuum pressure of system. The primary compressor assembly 4 may be started through an electrical pressure permissive start motor control after the correct vacuum is reached. The condensate in the plenum chamber flows back into the evaporator through a simple restrictor control 15 into the evaporator tank to be recooled and reflashed in the spray manifold 8*c* shown in FIG. 1 and 2. The small motor driver vacuum pump 7 does not operate continuously but only pumps or purges leaking air out of the system when the system is operational. It does, however, operate to initially pump down pump the system to initiate the system starting vacuum and in normal vacuum terminology would be characterized as a forepump or a backing pump.

(g) Another unique operational characteristics and advantage of the water vapor vacuum refrigeration system favoring the non-conventional condenser plenum is the huge condenser energy savings and the elimination of the evaporator heat exchanger to isolate the refrigerant gases from the cooling water. The vacuum compressor assembly 4 of FIG. 1 and FIG. 2 will not reach the high thermodynamic temperature rise of compression for the required compression ratio as conventional refrigeration compressors but a temperature rise much lower. A temperature rise of approximately one-third of the compressor thermodynamic temperature rise will allow great improvement of the overall cycle efficiency. This phenomenon is due to the low vapor density and low power dissipation in the compressor. The actual compression process approaches an isothermal compression instead of an isentropic adiabatic with losses as in conventional compressors which have above atmospheric pressure cycles. This lower temperature of compression is a huge cycle efficiency advantage for the compressor assembly 4.

(h) The design of the unique new water vapor vacuum compressor assembly unit is shown as drawing FIG. 3. The vacuum compressor depicted is a 5 ton unit but can be designed for other sizes but not limited to 3.5 to 65 ton refrigeration capacity water vacuum air conditioning systems. Without the above unique compressor unit, the designer would have to resort, at present to the non-suitable or non-practical positive rotary type compressor vacuum units such as the large positive Roots type or the very large impractical multistage centrifugal compressor, or use inefficient compound steam ejectors systems as presently done.

Figure 3A:
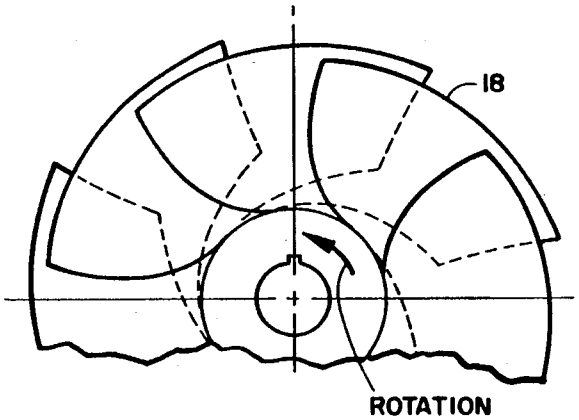
FIG. 3*a* shows a front perspective view of the inlet inducer impeller to the vapor vacuum compressor of FIG. 3.

The compressor unit drawing, FIG. 3, has two separate designed sections of compression affixed to a single rotating shaft as follows:

(a) An encased inducer inlet section 18 is designed as a axial-mixed flow compressor inducer. A front view of the inlet is shown in FIG. 3*a*. The purpose and need of the inducer is to increase the inlet flow potential, the efficiency and flow-through vapor velocities to the low propelling vane angles of the compression second section, wrap around vane unit which historically suffer from poor inlet and low flow-through capabilities. This requirement is not unlike the need for the common inlet inducer sections on the inlets of centrifugal compressor impellers. The inducer is a common turbomachinery term for a fluid dynamic configuration or a physical inlet part of an impeller. For further reference refer to the classical text or the *Principles of Turbomachinery* by Dr. D.G. Shepherd, MacMillan Publishing Company, page 225, paragraph 6.2, copyrighted in 1956. The inducer section is designed to increase the vapor flow actual relative blade velocity to the vanes of the second dissimilar compressor section and match the low actual angles of the vanes, allowing for aerodynamic slip, entrance angles without a relative velocity change from the outlet of the inducer to the outlet of second section compressor vanes, thus having a continuous path without free diffusion or not allowing the vapor to enter an annular area to regain static pressure. The diagram of one vane of the "conformal transformation" of both the inducer section and the compression second vane section is shown with the flow mean velocity diagrams in FIG. 3*b*. FIG. 3*c* shows a open casing partial section view of the rotating inducer and the inlet sections of the compressor.

Figures 3B, 3D:
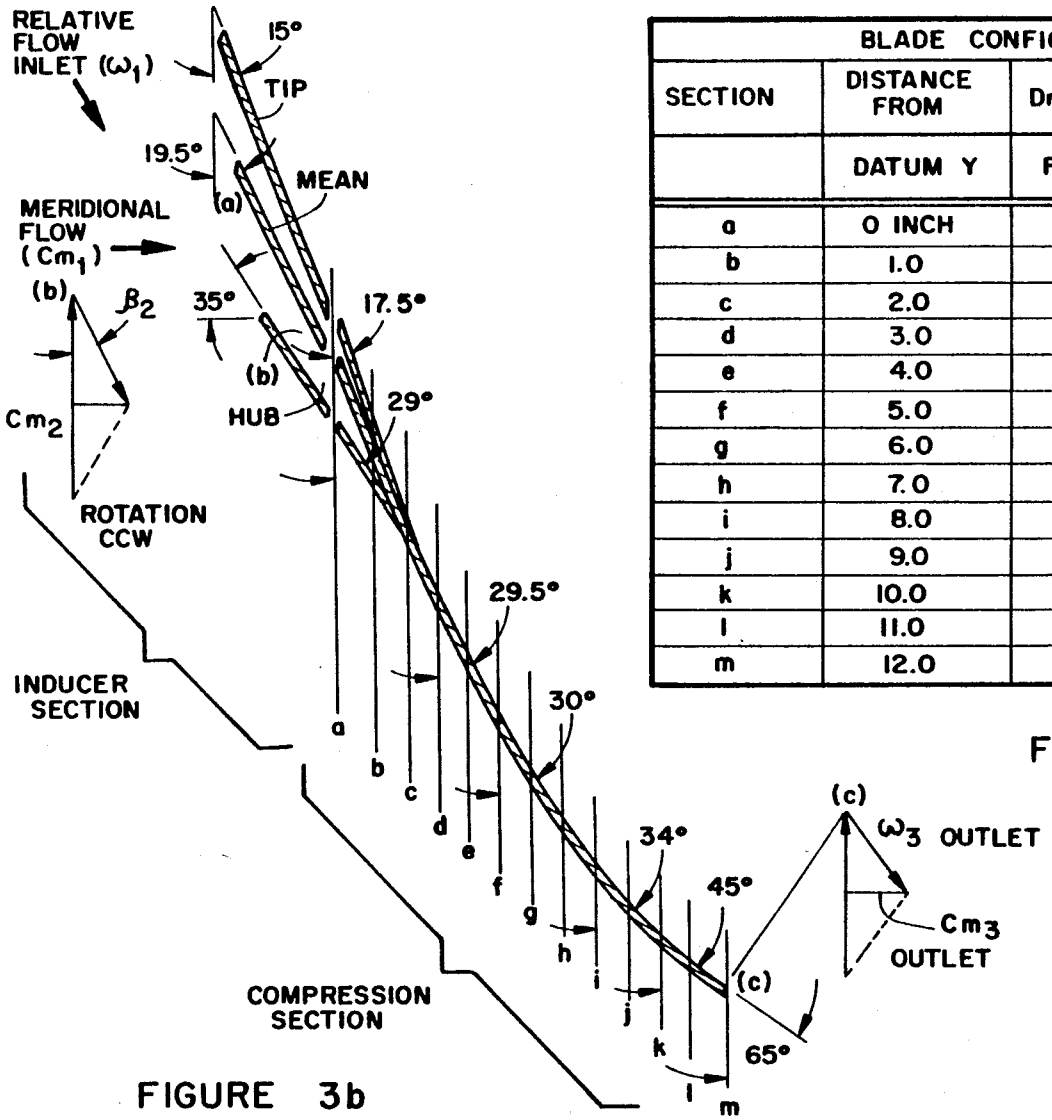
FIG. 3*b* show a perspective view of the arrangements of rotating blading of the compressor of both the inducer and vane sections.

(b) the encased axial vane second section of the compressor is shown as 19 of FIG. 3*c*. The vanes are designed to obtain the necessary compression ratio and volume ratio to condense the vapor back to liquid for the design compression ratio. FIG. 3 shows the non-linear flow annular area layout of the second compressor section for reference. A vane channel dimensional design table is shown as FIG. 3*d*. At each axial station of the compressor the areas and vane angles are not similar but fit the requirements of an exponential curve. For visual clarity this 5 ton unit, pertinent overall dimensions are shown. FIG. 3*b* shows the vane angles in the "conformal transformation" section of one vane. The 8 vanes of this 5 ton unit wrap the basic hub 360 degree and terminate with a section 65 degrees from the tangential plane thus designing for aerodynamic velocity outlet diagram correctness and acceptable absolute velocity angle into the attached condenser section of FIG. 4. The diameters wrap angle and number of vanes will vary with each size. The inlet sections to the second compressor has the inlet blade twisted to match the actual flow outlet angles of the inlet inducer. The vane angles of the second compressor section varies from inlet to outlet following the conformal transformation diagram for FIG. 3*b*. The outer casing of the second compression stage is conical for volume ratio requirement and reduce leakage and backflow requirements.

The compressor would have a bearing-seal arrangements as in compressor similar to state of the arts vacuum units. The inducer item 18 of FIG. 3 and second vane section item 19 is keyed to drive shaft 20 by shaft drive keys, items 21 and 24. The shaft bearing assemblies of 23 support the shaft. The bearings type will vary with size but generally will be antifriction of angular contact type with special vacuum oil or grease seals shown as 22. Item 26 shows the front inlet bearing-shaft support of 4 aerodynamics shaped columns. Item 27 is a labyrinth type housing seal.

The conical casing of the second vane compressor section may be sleeved, but not shown, on the larger sizes of compressors to control the small required casing clearances. Other similar mechanical arrangements could be utilized. Item 24 is an internal keyed sleeves. The inlet compressor wear seal is a 360 degree to band each of the 8 vanes as and is shown as item 25. The compressor unit would be driven through a shaft system by an electrical motor as FIG. 1, item 6 as commonly supplied for conventional air conditioning units. The motor and controls could be weather enclosed as shown by item 6*a*. The compressor assembly 4 requires no injection oil and, therefore, may have higher rotational speeds as compared to conventional positive compressors which require internal refrigerant oils.

The separate small system vacuum pump FIG. 1 item 7 may be mounted on the top of a round, rectangle or square evaporation tank as shown in FIG. 1 or at the tank 2 ground level.

The axial mixed flow type inducer may be affixed as one piece to the second main vane compression section or as two as shown in FIG. 3 and FIG. 3*c* on a common compressor shaft 20.

SUMMARY, RAMIFICATION AND SCOPE OF INVENTION

The main advantages of the water vapor vacuum refrigeration system are documented in the object and advantage section of this document. The thermodynamics of flash cooling is well known but the use of this refrigeration means has been limited to very large system with multi-ejector vacuum pumps. The use of the new type vapor vacuum compressor of FIG. 3 will allow much smaller and more efficient water vapor vacuum refrigeration systems to be practical. When an efficiency comparison is made between the present state of the art refrigeration systems using Chlorofluorocarbons or the new HCFC gases, the thermal and performance efficiency of the water vapor vacuum refrigeration system will be much higher. Practical analytical research shows actual system coefficient of performances, COP, over 7.25, which in many cases is over 80 to 100 percent higher efficiencies than present state of the art refrigeration systems. This has large ramification to national power requirements of the U.S. since most of the air conditioning and refrigeration power used is by units less than 65 ton capacity. The closed system operation of the water vapor vacuum refrigeration units requires no additional water after the original or initial filling of the tank. Any make up water required, would be due to mechanical leaks. This is not true of the conventional open systems of the state of the art. The conventional condensers of the state of the art air conditioning and refrigeration systems requires external ambient air or external water cooling by direct coil heat exchangers, evaporative cooling, or condensing towers, and are dependent on outside ambient conditions. This dependency causes loss of efficiency and capacity as the ambient temperatures increase. The water vapor vacuum refrigeration system is a totally enclosed system with practically no effects of ambient conditions on system efficiency. There is also no need for evaporator heat exchangers for isolating the refrigerant gases from the flowing cooling water.

FIG. 1 shows one arrangement of the water vacuum vapor refrigeration systems. There could be other arrangements but would require similar components.

The new vapor vacuum compressor could take other geometric forms depending on size or the refrigeration requirements but would always require an inlet multi vaned inducer and a second multi vaned like axial rotor for the compressor to accomplish the high compression ratios required.

The operating water temperature may be changed to lower temperatures by adding glycol to the water to prevent freezing. The required operating vacuum and condensing pressure would also require slightly lowering the system pressure.

Simple controls can be installed to the system such as a level control to control valve 1 of FIG. 1; pressure permissive start switch, not shown, to control the drive motor 6 and vacuum pressure control, not shown, to control the small motor 7 vacuum air pump. All controls are of minimal cost and well within the state of the art. Other type of controls may be desired. No intermediate speed control is required of the compressor drive motor since the system will operate at full speed or be shut down.

WHAT IS CLAIMED IS:

1. A water vapor vacuum refrigeration system comprising: an insulated water storage tank having a predetermined level of water therein;

a vacuum pump connected to said water storage tank for producing a predetermined vacuum level in said water storage tank;

first means in said water storage tank at a height above said water level for flashing water into vapor;

means for using cooled water in said water storage tank in a water-type refrigeration unit;

a water vapor vacuum rotating compressor assembly comprising a mixed flow inducer section and a compression vane section;

said mixed flow inducer section having an inlet port and an outlet port, said inducer section having an outer annular wall and an internal cone-shaped hub whose outer diameter is smallest at said inlet port and greatest at said outlet port, a plurality of inducer blades extend outwardly from said cone-shaped hub and they extend axially along said cone-shaped hub in a spiral pattern, said rotating inducer blades having means for changing the angular incidence of low pressure vapor passing through said inducer section to produce a first predetermined angular pressurized outlet flow;

said rotating compression vane section having an inlet port and an outlet port, said compression vane section having an outer annular wall and an internal longitudinally extending compression hub, the cross sectional area of said inlet port being greater than the cross sectional area of said outlet port, a plurality of compression blades extend outwardly from said compression hub and the compression blades extending axially along said hub in a spiral pattern, said compression blades having means for changing the angular incidence of fluids passing through said compression vane section to produce a second predetermined angular outlet pressurized vapor flow;

means connecting the outlet port of said mixed flow inducer section to the inlet port of said compression vane section in such close proximity that there isn't any substantial diffusion of the velocity of the vapor between the time the vapor exits the outlet port of said inducer section and enters the inlet port of said compression vane section; and means connecting the area of said water storage tank above said water level to the inlet port of said mixed flow inducer section.

2. A water vapor vacuum refrigeration system as recited in claim 1 further comprising an integral condenser unit connected to the outlet port of said compression vane section for removing the heat of compression of said water vapor vacuum compressor assembly.

3. A water vapor vacuum refrigeration system as recited in claim 2, further comprising means for recuperating a portion of load returning water to cool the condenser unit thus forming an enclosed water vapor vacuum refrigeration system.

4. A water vapor vacuum refrigeration enclosed system as recited in claim 1 wherein the performance cooling capacity is not effected by outside ambient air or outside tap water temperatures thus resulting in a high overall thermal system efficiency.

5. A water vapor vacuum refrigeration system as recited in claim 1 further comprising means for rotating the cone-shaped hub of said mixed flow inducer section and the compression hub of said compression vane section in unison.

6. A water vapor vacuum refrigeration system wherein the means recited in claim 5 comprises a motor having a drive shaft and said cone-shaped hub and said compression hub are fixedly mounted thereon so that they rotate as a single structure.

7. A water vapor vacuum refrigeration system as recited in claim 1 further comprising means for removing water droplets from said vapor before it enters the inlet port of said mixed flow inducer section.

8. A water vapor vacuum refrigeration system as recited in claim 2 further comprising means for delivering condensate from said condenser unit back to said water storage tank.

9. A water vapor vacuum refrigeration system as recited in claim 8 further comprising means in said water storage tank at a height above said water level for reflashing said condensate into vapor.

10. A water vapor vacuum refrigeration system as recited in claim 1 further comprising means for returning pressurized water that has been heated in the load heat exchanger to said water storage tank.

11. A water vapor vacuum refrigeration system as recited in claim 10 further comprising means in said water storage tank at a height above said water level for reflashing said heated water into vapor.

12. A water vapor vacuum refrigeration system as recited in claim 1 wherein there are at least 6 inducer rotating blades extending outwardly from the cone shaped hub of said mixed flow inducer section for propelling low pressure vapor into the rotating compression van section.

13. A water vapor vacuum refrigeration system as recited in claim 1 wherein said means for changing the angular incidence of vapor passing through said inducer section to produce a first predetermined angular outlet flow comprises said inducer blades having an axial curvature that increases continuously from said inlet port to said outlet port with its initial vane angle being in the range of 15 to 35 degrees from tangential direction and the vane angle at its exit being in the range of 15 degrees to 35 degrees tangentially.

14. A water vapor vacuum refrigeration system as recited in claim 1 wherein said means for changing the angular incidence of fluids passing through said compression vane section to produce a second predetermined angular outlet flow comprises said compression blades having an axial curvature that increases continuously from said inlet port to said outlet port with its initial vane angle being in the range of 15 to 35 degrees and the vane angle at its exit being in the range of 60 to 70 degrees tangentially.

15. A water vapor vacuum refrigeration system as recited in claim 1 wherein the maximum pressure across components or any construction wall or boundary of storage tank is less than 14.69 pounds per square inch.

16. A water vapor vacuum refrigeration system as recited in claim 1 wherein the outer annular wall of said compression vane section is conical in shape with its largest diameter adjacent its inlet port thereby producing a predetermined desired fluid compression ratio in the range of 4.50 to 6.00.

* * * * *